United States Patent [19]

Wegeng

[11] 4,199,879

[45] Apr. 29, 1980

[54] SAFETY SKI BOOT STRUCTURE

[76] Inventor: Wendell A. Wegeng, 607 Alder, Sandpoint, Id. 83864

[21] Appl. No.: 933,814

[22] Filed: Aug. 15, 1978

[51] Int. Cl.[2] ..... A43B 5/04

[52] U.S. Cl. ..... 36/121

[58] Field of Search ..... 36/117, 120, 121

[56] References Cited

U.S. PATENT DOCUMENTS

| | | | |
|---|---|---|---|
| 3,718,995 | 3/1973 | Graup | 36/121 |
| 3,735,508 | 5/1973 | Gertsch et al. | 36/121 |
| 4,078,322 | 3/1978 | Dalebout | 36/121 |

FOREIGN PATENT DOCUMENTS

| | | | |
|---|---|---|---|
| 2635998 | 3/1977 | Fed. Rep. of Germany | 36/121 |

*Primary Examiner*—Patrick D. Lawson

*Attorney, Agent, or Firm*—Wells, St. John & Roberts

[57] ABSTRACT

A safety ski boot structure is described that allows a skier to flex his lower leg relative to his foot in forward, rearward, vertical, rotational and lateral directions. The structure includes a shoe member and a cuff member that are interconnected by helical compression springs. The springs are designed and arranged so that relatively moderate force is required to pivot the cuff members forward and back so as to enable the skier to readily execute turns and accommodate to varying terrain. The springs are designed and arranged so that a relatively large force is required to pivot or move the cuff member laterally or rotationally to enable the skier to readily control the edges of his ski while enabling lateral or rotational movement of the skier's leg should the skier fall or hit an object. Such a lateral and rotational feature minimizes the likelihood of leg breakage.

3 Claims, 5 Drawing Figures

SAFETY SKI BOOT STRUCTURE

BACKGROUND OF THE INVENTION

The present invention is related to ski boot structures and more particularly to such boot structures utilizing a shoe member and a cuff member that are yieldably interconnected.

The sport of snow skiing involves the use of skis of many different forms, but basically only two different types of ski boots. Boots that are utilized in situations that require a substantial amount of freedom for ankle movement are relatively low-cut and flexible. Examples of this form of boot are used in ski jumping and cross country skiing.

Another form of boot that is utilized is a higher-topped boot that severely restricts, if not totally bypasses the lateral and rotational articulating function of the skier's ankle joints. Such boots are used in downhill skiing. The lateral rigidity imparted by such rigid boot structures enables skiers to place greater stress on the lower leg area for purposes of turning and controlling "edging". The difficulty, however, is in safety. Greater injury may incur from the rigid boot structure wherein dangerous compound fractures of the fibula and tibia are common.

It is desirable to provide a ski boot structure that is safer and less likely to be conductive to leg fractures without substantially compromising "edging" control.

BRIEF DESCRIPTION OF THE DRAWINGS

A preferred and alternate embodiment of this invention is illustrated in the drawings, in which.

DETAILED DESCRIPTION OF THE INVENTION

Figure 1:
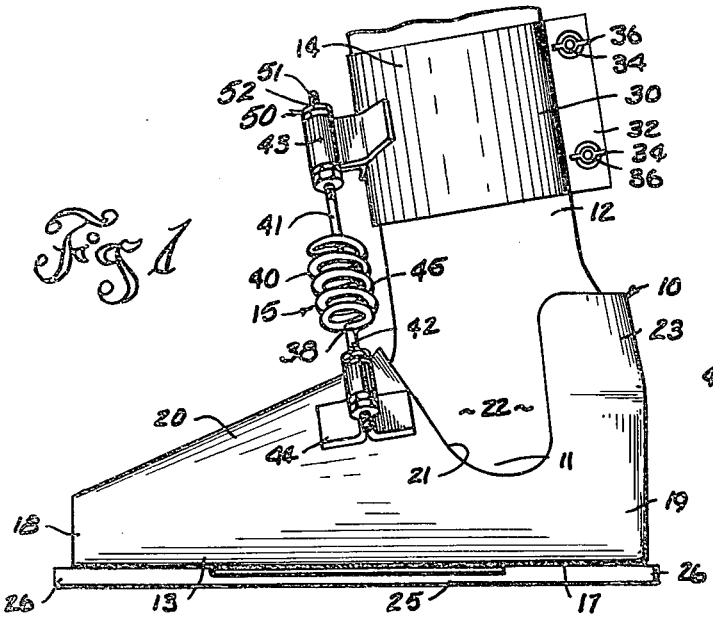
FIG. 1 is a side elevation view of a preferred embodiment of the boot structure.

The present ski boot structure is indicated in the accompanying drawings by the reference character 10. The boot structure 10 is designed to receive the foot 11 and lower leg 12 of a skier. The structure is comprised of a shoe member 13 and a cuff member 14. The shoe member and cuff member are pivotally interconnected by articulating cuff support means shown generally at 15 to enable the lower leg 12 to articulate forward and rearward, vertically, rotationally and laterally with respect to the foot through the ankle joint.

The shoe member 13 includes a relatively flat sole 17 leading from a toe end 18 to a heel 19. A vamp 20 extends from the toe 18 to an ankle portion 21 which is recessed elevationally to allow free reception and articulation of the skier's ankle 22. The ankle portion 21 leads rearwardly to an upright heel brace 23 that is designed to fit snugly and immovably against the skier's heel and Achilles tendon. Along the sole 17 is a ski binding receiving means 25 which may simply be comprised of forward and rearwardly projecting tabs 26. The ski binding receiving means 25 may be of different forms to receive and mount different types of ski bindings.

The shoe member 13 is constructed of substantially rigid material such as appropriate synthetic resins and may be lined with soft or resilient material for the comfort of the skier.

The cuff member 14 is constructed essentially of the same material as the shoe member 13. Cuff member 14 is basically comprised of a relatively rigid collar 30 that may be split along its length at 31 to facilitate mounting about a skier's lower leg. The construction of cuff member 14 is such that the collar may be of many different forms to enable the skier to easily "put on" and "take off" his ski boots. In one form, collar 30 may be separated at the split area 31 to facilitate expansion of the collar and reception of the skier's leg therein. The split area is defined by opposed rearwardly projecting flanges 32. These flanges 32 receive a clamp means 36 that may be selectively adjusted to firmly secure the clamp member to the skier's lower leg. Clamp means 33 may basically comprise a thumb screw arrangement such as shown at 34 or may be provided in the form of one or more buckles or other appropriate connection devices. Appropriate padding (not shown) may also be provided inward of the cuff member to engage the skier's leg.

Although not shown, it is contemplated that a flexible covering such as fabric, leather or sheet material will extend between the cuff member 14 and the shoe member 13 that will keep snow out of the shoe member 13 without substantially interferring with the articulation of the cuff member 14 with respect to the shoe member 13.

The articulating cuff support means 15 is basically comprised of a pair of helical compression springs 40 that interconnect the shoe member 13 with the cuff member 14. Each helical compression spring 40 includes a central or intermediate open coil section 45 having a number of normally nonengaging turns to enable the coil to compress, extend and bend. The open coil section 45 is formed integrally with axial end sections 41 and 42 that extend axially outward from the coil section 45 for connection to the cuff member 14 and shoe member 13 respectively. The axial sections 41 and 42 are mounted by adjustable brackets 43 and 44 respectively to the cuff member 14 and shoe member 13. The size, material and strength of the open coil section 45 may vary depending on many factors including the size and weight of the skier. Additionally, the length of the axial end section 41 and 42 from the coil section 45 to the brackets 43 and 44 respectively may be adjusted depending on many factors including the size and weight of the skier and "flexural stiffness" that the skier may prefer.

The orientation and location of the helical compression springs is dictated by the requirement that during lateral (side) displacement of the cuff member 14 with respect to the shoe member 13, one spring 40 be placed substantially in compression while the other spring 40 be placed substantially in tension. This relationship is shown diagrammatically by dashed lines in FIG. 3. The axial sections 41 and 42, during lateral displacement, act as compression columns against the coil section 45 of the spring on one side and as columns under tension on the other side. Deflection is therefore produced substantially in the coil sections 45 of the springs 40 although some very slight deflection due to bending may occur within the axial sections 41 and 42 and the coil section 45.

During forward or rearward or rotational movement of the cuff member 14 relative to shoe member 13, the springs 40 are deflected mainly by bending forces causing the axial sections 41 and 42 and the coil section 45 to deflect laterally with respect to the spring axis. The springs 40 and the brackets 43 and 44 are designed so that the force required to laterally displace the cuff member 14 to one side or the other is far greater than the force required to move the cuff member 14 in a forward or rearward direction (longitudinal direction with respect to the ski). Additionally, the helical compression springs 40 enable the cuff member 14 to move vertically with respect to the shoe member 13 to serve as shock absorbers.

When a compressional or tensional force is applied to the end sections 41, 42 such as during lateral or up and down movement of the cuff member 14, the coil section 45 is subjected to a predominant torsional moment tending to twist the coiled wire about the helical axis of the wire. The torsional moment applied to the coil section is the product of the compressional or tensional force and the radius of the coil section 45 from the axis or center line of the coil section to the helical axis of the coiled wire. When a bending force is applied to the end sections 41, 42, such as during forward or rearward or rotational movement of the cuff member 14, the coil section 45 is also subjected to a predominant torsional moment tending to twist the coiled wire about the helical axis of the wire. However, in such case, the torsional moment applied to the coil sections is the product of the bending force and the distance or length of the end sections 41, 42 from the coil sections 45 to the brackets 43, 44.

Consequently, it is an important feature of this invention that the helical coil springs 40 be selected, arranged and attached between the cuff member 14 and the shoe member 13 so that a greater compressional or torsional force is required to move the cuff member laterally or vertically than the bending force required to move the cuff member forward or rearward. In a preferred embodiment, this is accomplished by providing the end sections 41, 42 with a length from the coil section 45 to the brackets 43, 44 that is substantially greater than the radius of the coil section from the axis or center line of the coil section to the helical axis of the coiled wire.

Applicant has found excellent results are obtained if the distance or length of the end sections 41, 42 from the coil sections 45 to the brackets 43, 44 is in excess of three times the coil section radius. In such a configuration, the force required to move the cuff member 14 laterally or vertically is more than three times greater than the force required to move the cuff member forward or rearward.

It is desirable to select the springs size and stiffness, and the length (of end sections 41, 42) to coil section radius ratio so that the springs 40 provide moderate resistance to forward or rearward movement of the cuff member and rather strong resistance to lateral or vertical movement of the cuff member. Such a feature enables the skier to readily execute turns and maintain good "edging" control while providing lateral and vertical leg flexibility should the skier fall or collide with an object.

Figure 2:
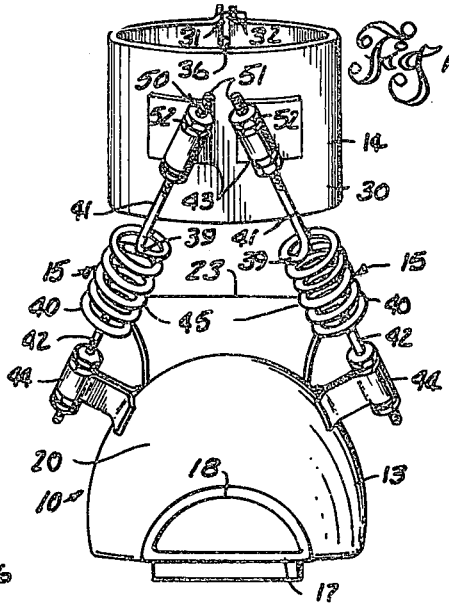
FIG. 2 is a front elevation as seen from the left in FIG. 1.

In the preferred embodiment illustrated in FIGS. 1 and 2, the helical coil springs 40 are arranged with the lower ends affixed to opposite sides of the shoe member and extend upward, inward and forward at a converging angle with the upper ends affixed to a front portion of the cuff member. In such an arrangement, lateral movement of the cuff member results in predominantly compressional forces being applied to one coil spring and tensional forces being applied to the other coil spring. Forward or rearward or rotational movement of the cuff member results in predominantly bending forces being applied to the springs 40.

Figure 3:
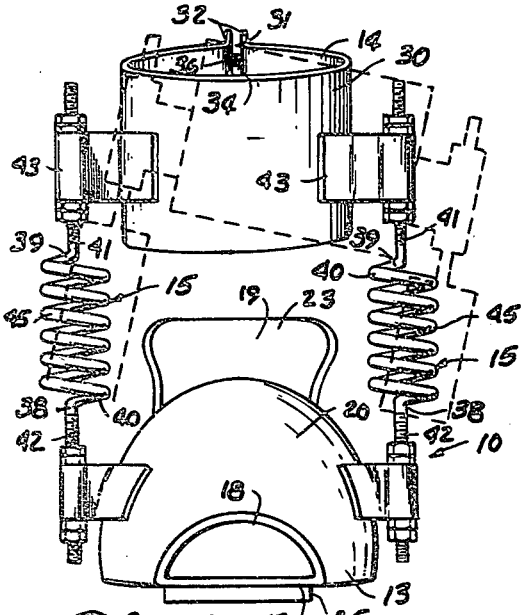
FIG. 3 is a front elevation of an alternate embodiment of the boot structure showing a different orientation of the helical compression spring elements therein and with a lateral operative position outlined by dashed lines.
Figure 4:
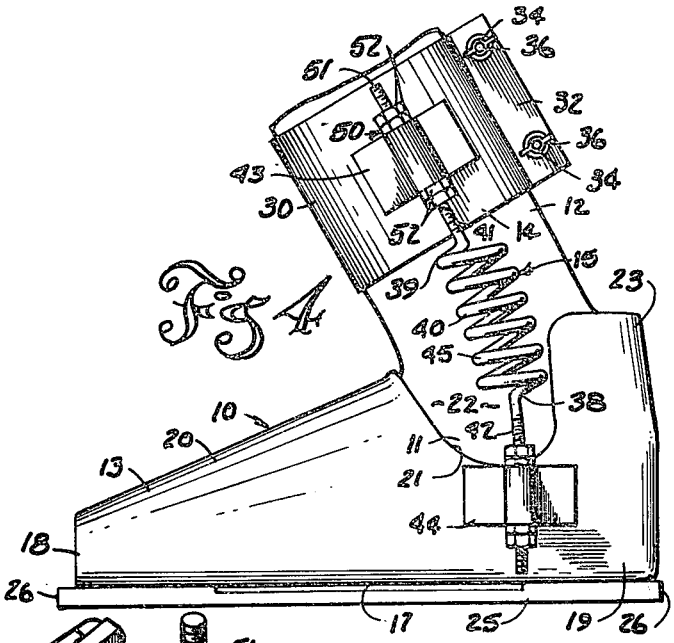
FIG. 4 is a side elevation view of the boot structure shown in FIG. 3 with the cuff member being forced forwardly against resistance offered by the springs.

In the alternate embodiment illustrated in FIGS. 3 and 4, the springs 40 are arranged vertically alongside the ankle with the springs extending substantially upright. In such a configuration, lateral movement results in a combination of compressional/tensional forces and bending forces being applied to the springs 40, while forward or rearward or rotational movement still results in predominately bending forces being applied to the springs 40. Consequently the location and orientation of the springs 40 between the cuff member and shoe member may be varied to obtain the desired forward to lateral spring resistance.

As an additional feature, the preferred and alternate embodiments provide an adjustment means 50 to adjust the effective length of the end sections 41, 42 from the coil section 45 and the brackets 43, 44. This enables the skier to adjust the moment arm of the springs 40 and thereby adjust the forces required to deflect the spring 40 during bending. This enables the boot to be adjusted to various size and strength skiers as well as enabling a skier to adjust the springs 40 to various terrains and skiing conditions.

Figure 5:
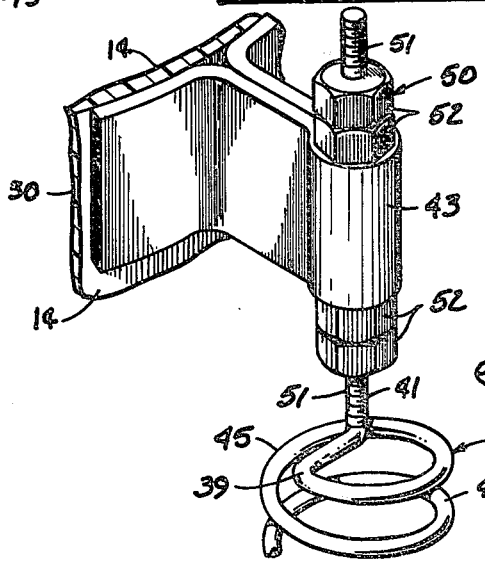
FIG. 5 is an enlarged isometric view of a fragment of the present structure.

An example of an adjustment means 50 is shown in FIG. 5. The example illustrates that the axial end sections 41, 42 are provided with threaded portions 51 that are slidably received within brackets 43, 44. Nuts 52 are threaded on portions 51 to secure the end sections 41, 42 to the brackets 43, 44. The nuts may be rotated to either increase or decrease the effective length of the end sections 41, 42.

It should be understood that the above described embodiments of this invention are illustrative examples and that numerous other embodiments may readily be devised within the scope of this invention. Only the following claims are intended to define this invention.

What is claimed is:

1. A safety ski boot structure for receiving a skier's foot and lower leg, comprising:

a shoe member for receiving a skier's foot;

a cuff member having a central cuff axis for receiving the skier's lower leg;

an articulating cuff support means operatively interconnecting the shoe member and the cuff member for firmly supporting the cuff member above the shoe member and for enabling the cuff member to be forcibly articulated by the skier's lower leg in four dimensions with respect to the shoe member;

said articulating cuff support means comprises a plurality of helical compression springs mounted in an upright orientation at angularly spaced locations about the cuff axis with upper ends rigidly fixed to the cuff member and lower ends rigidly fixed to the shoe member to prevent the fixed ends from moving with respect to the respective members;

said helical compression springs having intermediate coil sections that are bendable, compressionable and extensible to enable the cuff member to forcibly articulate (1) in a first forward or backward dimension with respect to the shoe member when the skier's lower leg exerts a corresponding forward or backward force of sufficient magnitude to the cuff member, (2) in a second lateral dimension with respect to the shoe member when the skier's lower leg exerts a corresponding lateral force of sufficient magnitude to the cuff member, (3) in a third vertical dimension with respect to the shoe member when the skier's lower leg exerts a corresponding vertical force of sufficient magnitude to the cuff member, and (4) in a fourth rotational dimension about the central cuff axis with respect to the shoe member when the skier's lower leg exerts a corresponding rotational force of sufficient magnitude to the cuff member to minimize injury to the skier's lower leg.

2. The safety ski boot structure as defined in claim 1 wherein the articulating cuff support means includes opposed helical compression springs mounted on opposite sides of the shoe member operatively interconnecting the cuff member to the shoe member so that when the cuff member is moved laterally one of the springs is placed in compression and the opposite spring is placed in tension.

3. The safety ski boot structure as defined in claim 2 wherein the upper ends opposed helical compression springs are rigidly fixed to a front portion of the cuff member.

* * * * *